United States Patent [19]

Jennings

[11] Patent Number: 4,892,332

[45] Date of Patent: Jan. 9, 1990

[54] BRAKING SYSTEM FOR ROLLER SKIS

[76] Inventor: Ryan Jennings, 1 Apple La., Glen Falls, N.Y. 12801

[21] Appl. No.: 267,448

[22] Filed: Nov. 4, 1988

[51] Int. Cl.[4] ..... A63C 17/04

[52] U.S. Cl. ..... 280/842; 188/5; 280/11.2

[58] Field of Search ..... 188/4; 280/842, 843, 280/11.19, 11.2, 87.042, 87.041

[56] References Cited

U.S. PATENT DOCUMENTS

| | | | |
|---|---|---|---|
| 2,545,543 | 3/1951 | Bottrill | 280/842 |
| 4,021,052 | 5/1977 | Knowles | 280/11.2 |
| 4,054,296 | 10/1977 | Sullins | 280/11.2 |
| 4,088,334 | 5/1978 | Johnson | 280/11.2 |
| 4,102,541 | 7/1978 | Altorfer et al. | 280/842 |
| 4,235,448 | 11/1980 | Thomas | 280/842 |
| 4,273,345 | 6/1981 | Ben-Dor et al. | 280/11.2 |
| 4,460,187 | 7/1984 | Shimizu | 280/842 |

OTHER PUBLICATIONS

"Inside Edge Fall 88 Skier's Catalog", pp. 1 and 2.

*Primary Examiner*—Charles A. Marmor
*Assistant Examiner*—Michael Mar
*Attorney, Agent, or Firm*—Nixon & Vanderhye

[57] ABSTRACT

Roller skis have an effective braking system. At least one friction producing braking element, such as a truncated cone of friction producing plastic resin (e.g. polyurethane) or rubber, is mounted to the bottom of a roller ski so that it overlaps the inner edge of the roller ski, positioned along the roller ski generally at the position at which the ski boot is mounted. The braking element may be connected to the roller ski by a separate attachment comprising a channel-shaped element with a screw clamp for connecting the channel-shaped element to the ski, and with the braking element extending downwardly from the channel. When it is desired to stop while practicing Nordic skiing (cross-country skiing) or Alpine skiing, the skier simulates a "snow plowing" maneuver, which brings the braking elements at the inside edges of both skis into contact with the ground, causing the roller skis to stop.

14 Claims, 2 Drawing Sheets

BRAKING SYSTEM FOR ROLLER SKIS

BACKGROUND AND SUMMARY OF THE INVENTION

The invention relates to roller skis having a braking system, and an attachment that may be retrofit onto a wide variety of roller skis to effect braking thereof. Roller skis are becoming increasingly popular both with snow skiers and the general public. Roller skis are useful for practicing Nordic and Alpine skiing without snow. Both Nordic techniques used on snow—classical (diagonal) and skating—are also used on roller skis.

While conventional commercially available roller skis, such as those sold under the trade name and trademark Swenor "Road-Ski" ®, are very effective in allowing one to practice cross-country (Nordic) skiing techniques, they have a significant drawback in that it is extremely difficult to effect braking of the roller skis. Some commercially available skis have a lever protruding above the front wheel, but this lever is difficult to grasp while skiing and even when the lever is activated and a force applied thereby, it really works only as a speed governor rather than as a brake. While a wide variety of other techniques for braking roller skis have been proposed, none have met with significant commercial acceptance.

According to the present invention a roller ski assembly is provided which has a braking system associated therewith that can effectively brake the roller skis, and in a manner that is in conformance with typical skiing techniques, is safe, and does not require any unnatural movements. For example rather than being required to bend down and activate a lever on a roller, the braking system according to the invention operates when the skier simulates a "snow plowing" technique, in which the skier bends his/her legs and feet inward so as to move the inner edges of the roller skis downwardly in a "V" pattern created by the fronts of the skis pointed inward and the backs pushed outward. This snow plowing action simulates a stopping motion with real snow skis, both Nordic (cross-country) and Alpine, and thus the braking action is a natural skiing maneuver.

The invention is particularly applicable to roller skis, as opposed to roller skates (such as roller skates having in-line rollers simulating an ice skate blade). A typical roller ski has an elongated body with substantially flat top and bottom surfaces, an inside side edge and outside side edge, and front and rear ends. Means are provided for mounting a piece of footwear on the top surface of the ski body, typically at a location thereon closer to the rear end than the front end. The footwear mounting means typically comprises a conventional boot clamp for clamping the boot or shoe of the skier, in a manner identical to that on a cross-country ski. Roller means, such as an individual roller, are disposed at each of the front end and rear end of the ski body for mounting the ski body for rolling movement along a traversable surface.

According to one aspect of the present invention, at least one friction producing braking element is provided for effecting braking of the rolling movement of the ski body when the element is brought into engagement with a traversable surface. Also means are provided for mounting the braking element to the ski body so that the element is normally and always spaced from a traversable surface, except when the skier simulates a snow plowing action, at which time the braking element is brought into engagement with the traversable surface to effect braking of the ski body.

Typically a friction producing braking element is provided on each of a pair of skis, the skis being substantially identical (the only differences may be the exact details of a clamp depending upon whether the clamp was adapted to receive only a right shoe, or only a left shoe, shoes of either orientation, etc.). Typically the braking element is mounted so that the operative center thereof is disposed on a plane that extends approximately through the center of the footwear in a dimension perpendicular to the direction of elongation of the ski body, or laterally in the direction of the instep. A portion of the braking element is disposed beneath the ski body, and a substantial portion extends past a plane containing the inside edge of the ski body so that the braking element is out of contact with a traversable surface when the top surface of the ski body is substantially horizontal, but moves into contact with the traversable surface when it is not. Each braking element may comprise a body molded from a friction producing plastic resin, or rubber (natural or synthetic) and may have the shape of a truncated cone.

According to the invention it is also desirable to be able to provide a structure that may be retrofit onto existing roller skis, since there are a large number of roller skis out in the marketplace that have no braking system associated therewith. Therefore the invention also relates to a simple yet effective attachment of a roller ski for providing braking capability for the roller ski.

The attachment of the invention comprises a channel-shaped element having a bottom, first and second upstanding sides generally perpendicular to the bottom, and an open top and ends. A screw clamp operatively associated with the first side of the element has a screw in screw-threaded relationship with the first side, and a ski engaging element attached to the screw and disposed between the first and second sides of the channel-shaped element. The braking element is of moderate friction material and is operatively connected to the bottom of the channel and extends downwardly from it, a portion of the braking element disposed beneath the bottom and a significant portion extending outwardly from a plane containing the second side of the channel-shaped element. The braking element may be attached to the channel-shaped element by internal screw threads which engage the external threads of a screw post extending downwardly from the channel-shaped element bottom.

Utilizing the roller ski assembly according to the invention it is possible to effect braking of roller skis by practicing a "snow plowing" action.

It is the primary object of the present invention to provide a simple yet effective braking mechanism for a roller ski, that does not require unnatural (for skiing) movements to actuate. This and other objects of the invention will become clear from an inspection of the detailed description of the invention and from the appended claims.

DETAILED DESCRIPTION OF THE DRAWINGS

Figure 1:
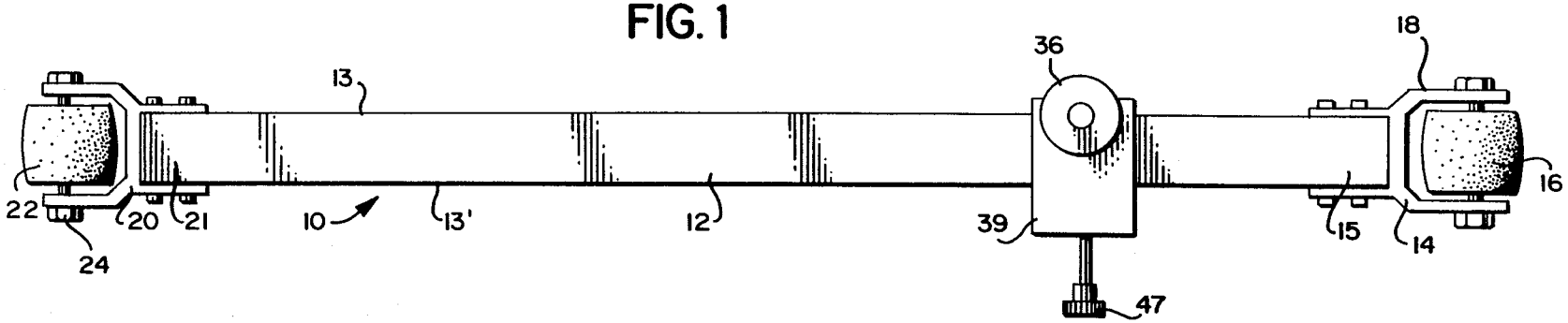
FIG. 1 is a bottom view of an exemplary roller ski according to the invention.
Figure 2:
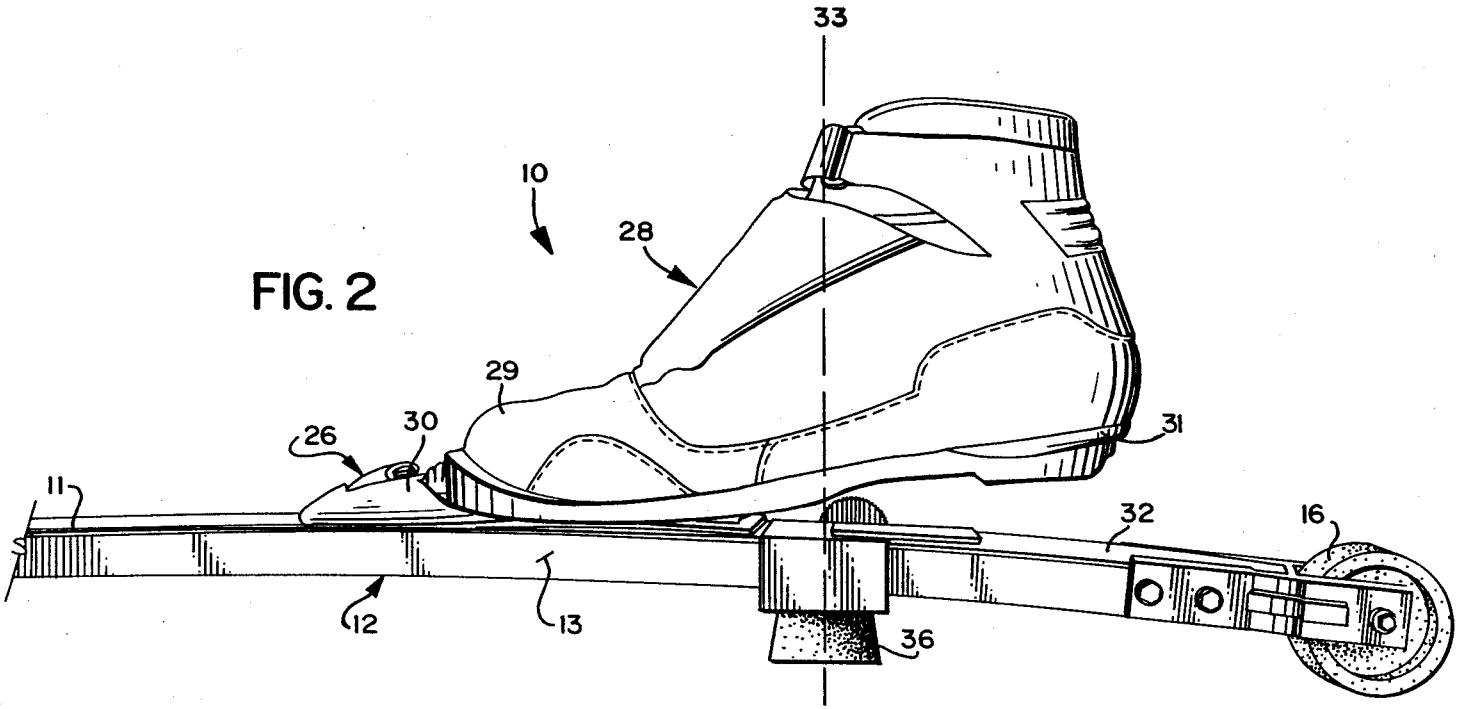
FIG. 2 is a partial side view of the roller ski of FIG. 1, showing the inside edge thereof.

A roller ski assembly according to the invention is illustrated generally by reference numeral 10 in FIGS. 1 and 2. The assembly 10 includes a ski having an elongated body 12 having substantially flat top (11) and bottom surfaces, an inside edge surface 13 and an outside edge surface 13'. It also includes a rear end 15 and a front end 21. Mounted to the ends are conventional brackets 14, 20 respectively for mounting rollers 16, 22 of rubber or the like, rotatable about axles 18, 24, respectively, the structures 14, 16, 18, and 20, 22, 24 comprising roller means disposed at the rear and front ends of the ski body 12 for mounting the ski body 12 for rolling movement along a traversable surface (e.g. pavement).

The assembly 10 also comprises means, shown generally by reference numeral 26 in FIG. 2, for mounting a piece of footwear, such as cross-country shoe or boot 28, on the top surface 11 of the ski body 12 preferably at a location thereon closer to the rear end 15 than the front end 21. The boot 28 typically would be mounted at its toe 29 by a conventional cross-country ski clamp 30. The heel 31 of the boot 28 typically would engage (when in the down position) a wear plate 32 on the top surface 11 of the ski body 12.

Figure 4:
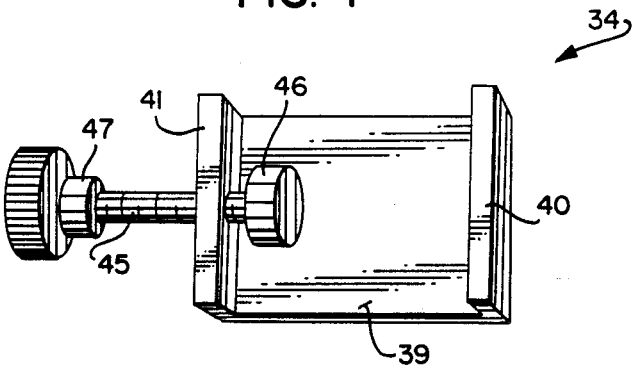
FIG. 4 is a top view of the attachment of FIG. 3.
Figure 3:
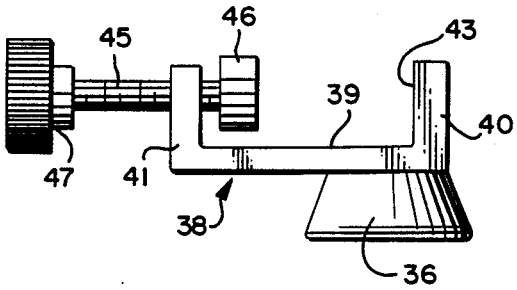
FIG. 3 is an end view of a ski brake attachment according to the invention.

What has been described heretofore is conventional, being typical of many commercially available roller skis, such as the Swenor "Road-Ski" ®. According to the invention a braking system is provided for utilization with the roller skis. In the preferred embodiment illustrated in the drawings the braking system is indicated generally by attachment 34 (FIG. 4), although it is to be understood that according to the invention the braking system could be integrally and permanently made a part of the ski itself.

The attachment 34 comprises a friction producing braking element 36 for effecting braking of the rolling movement of the ski body 12 when the element 36 is brought into engagement with a traversable surface (e.g. pavement, carpeting, grass, etc.). The invention is described with respect to only one friction producing braking element 36 on each ski, but it is to be understood that more than one could be provided, depending upon the particular requirements of the specific roller skis or skier, or the particular shape or construction or nature of the braking element 36. In the exemplary embodiment illustrated in the drawings, the element 36 comprises a single integral body molded from a friction producing plastic resin, or rubber, and having the shape of a truncated cone. However a wide variety of other shapes or configurations could be provided. Also the material of which the braking element 36 is made may vary widely, but typical friction producing plastic resins that could be utilized include polybutyl rubber, polyurethane, and polybutadiene styrene, as well as natural rubber or the like.

The attachment 34 also comprises a channel-shaped element 38 having a bottom 39, first and second upstanding sides 41, 40, respectively, which are generally perpendicular to the bottom 39, and an open top and ends. A screw clamp is operatively associated with the first side 41, preferably comprising a screw 45 in screw-threaded relationship with the first side 41, and a ski engaging element 46 attached to the screw 45 and disposed between the first and second sides 41, 40 of the channel 38. The element 46 may be a block of nylon which will not mar the edge 13' of the ski body 12 when tightened into contact therewith. On the opposite end of the threaded shaft 45 from the element 46 a knob 47 is preferably provided, although any other type of structure for facilitating turning of the screw 45 could be provided.

Figure 5:
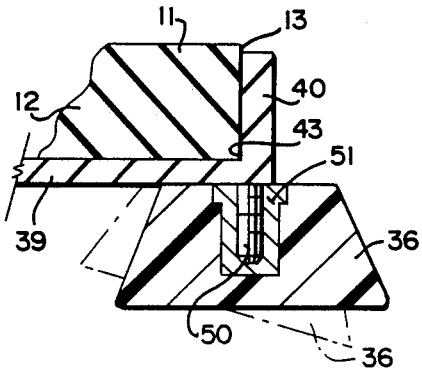
FIG. 5 is a detail cross-sectional view taken at the braking element of the ski assembly of FIGS. 1 and 2.

The channel 38 also includes an inner face 43 of the second upstanding side 40, which is adapted to engage the inner side edge 13 of the ski body 12. The channel 38 may be made of aluminum, plastic, or other suitable material, and preferably is lightweight yet strong. As illustrated in FIG. 5, the braking element 36 preferably is attached to the channel 38 via an externally threaded screw shaft 50 which is integral with the bottom 39 of the channel 38, and which is engaged by an inner collar 51 of metal extending along the central axis of the body 36, the interior screw threads on the collar 51 engaging the exterior screw threads on the shaft 50. As illustrated in FIG. 5, the inner surface 43 of the upstanding side 40 of the channel 38 engages the inner edge 13 of the ski body 12.

While the position of the attachment 34 along the length of the body 12 may be adjusted, one particularly advantageous position is illustrated in FIGS. 1 and 2, wherein it is disposed so that the operative center of the element 36 is approximately in line with the center line 33 of the boot 28 (that is between the front clamp 30 and the wear plate 32). This is the position at which the skier can exert maximum deflection on the ski body 12. In use, after the attachment 34 has been placed at the bottom of ski body 12 and the surface 43 brought into contact with the edge 13, the skier rotates the knob 47 to move the abutment 46 into tight clamping engagement with the ski edge 13', thereby holding the attachment 34 in place with the braking element 34 elevated above the traversable surface (e.g. pavement). At no time will the braking element 36 engage the traversable surface unless the skier effects a "snow plowing" action in which he/she moves his/her legs and feet toward each other, bending or twisting the ski body 12 about an axis generally coincident with the direction of elongation of the ski body 12 (the direction of movement of the skier), which causes the element 36 to deflect a downwardly (see the dotted line position in FIG. 5) so that it engages the pavement and therefore effects braking.

Under some circumstances only one braking element 36 is necessary, but desirably one is provided on each ski. As wear of the element 36 occurs, its position with respect to the bottom 39 of the channel may be adjusted by rotation thereof to provide vertical movement of the body 36 with respect to the channel bottom 39. Other adjustment mechanisms could also be utilized.

OPERATION

The skier takes attachment 34 and places it so that face 43 is in contact with side edge 13 of ski body 12, with the braking element 36 overlapping the side edge 13. The knob 47 is then rotated clockwise to bring the element 46 into clamping engagement with the side edge 13' so that the braking element 36 is tightly mounted onto the body 12, between the toe 29 and heel 31 of footwear 28.

The skier uses the roller ski assembly 10 in a conventional manner, except when it is desired to brake. Then the skier moves his/her legs in a snow plow simulating motion, the knees being bent inwardly. When the skier executes this maneuver, the braking elements 36 on both skis, located inwardly of the ski bodies 12, contact the surface being traversed (pavement, etc.) and bring the skis to a stop. The skis are typically parallel when the snow plow simulating motion is practiced, and the skis can be next to each other or one in front of the other. Alternatively, the tips of the skis may be closer to each other than the rear portions during braking.

While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent structures and devices and procedures.

What is claimed is:

1. A roller ski assembly comprising:

(a) a ski having an elongated body having substantially flat top and bottom surfaces, an inside side edge, and an outside side edge, and front and rear ends;

(b) means for mounting a piece of footwear on the top surface of said ski body at a location thereon closer to said rear end than said front end;

(c) roller means disposed at said rear end and said front end of said ski body for mounting said ski body for rolling movement along a traversable surface;

(d) at least one friction producing braking element for effecting braking of the rolling movement of said ski body when said element is brought into engagement with a traversable surface, said element being generally circular in cross-section; and (e) means for mounting said braking element to said ski body so that the operative portion of said braking element is disposed beneath said ski body, and the center of said generally circular cross section braking element is substantially disposed in a vertical plane containing said inside edge of said ski so that a substantial portion of said element extends horizontally away from said ski past said plane containing said inside edge of said ski body, but is unconnected to any other structure, and so that said braking element is out of contact with a traversable surface when said top surface of said ski body is substantially horizontal; and wherein the center of said braking element is substantially disposed in a vertical plane that extends approximately through the center of the footwear in a dimension perpendicular to the direction of elongation of said ski body.

2. An assembly as recited in claim 1 wherein said roller ski comprises a first roller ski, and further comprising a second roller ski substantially identical to said first ski, said skis being unconnected.

3. An assembly as recited in claim 1 wherein said braking element comprises a body molded from a friction producing plastic resin or rubber.

4. An assembly as recited in claim 1 wherein said braking element comprises a body having the shape of a truncated cone.

5. An assembly as recited in claim 4 wherein said braking element consists of said body in the shape of a truncated cone.

6. A roller ski assembly comprising:

(a) a ski having an elongated body having substantially flat top and bottom surfaces, an inside side edge, and an outside side edge, and front and rear ends;

(b) means for mounting a piece of footwear on the top surface of said ski body at a location thereon closer to said rear end than said front end;

(c) roller means disposed at said rear end and said front end of said ski body for mounting said ski body for rolling movement along a traversable surface;

(d) at least one friction producing braking element for effecting braking of the rolling movement of said ski body when said element is brought into engagement with a traversable surface; and (e) means for mounting said braking element to said ski body so that said element is normally and always spaced from a traversable surface, except when the skier simulates a snow plowing action, at which time said braking element is brought into engagement with a traversable surface to effect braking of said ski body; said means (e) comprising a channel-shaped element having a clamp associated therewith for operatively clamping said channel-shaped element to said side edges of said ski body, said braking element extending downwardly from the bottom of said channel-shaped element with at least a significant portion thereof extending inwardly from a plane containing the inside side edge of said ski body.

7. An assembly as recited in claim 6 wherein said braking element comprises a body molded from a friction producing plastic resin or rubber.

8. An assembly as recited in claim 7 wherein said body has the shape of a truncated cone, and wherein said at least one friction producing braking element consists of said body.

9. An attachment for a roller ski for providing braking capability for said roller ski, said attachment comprising:

a channel-shaped element having a bottom, first and second upstanding sides generally perpendicular to said bottom, and an open top and ends, the sides spaced from each other a distance greater than the width of a roller ski;

a screw clamp operatively associated with said first side of said element and having a screw in screw threaded relationship with said first side, and a ski-engaging element attached to said screw and disposed between said first and second sides; and a braking element of friction material operatively connected to said bottom and extending downwardly therefrom, a portion of said braking element disposed beneath said bottom, and a significant portion thereof extending outwardly from a plane containing said second side of said element.

10. An attachment as recited in claim 9 wherein said braking element comprises a body molded from a friction producing plastic resin or rubber.

11. An attachment as recited in claim 10 wherein said body has the shape of a truncated cone.

12. An attachment as recited in claim 10 wherein said body is attached to said channel-shaped element by internal screw threads which engage the external threads of a screw post extending downwardly from said channel-shaped element bottom.

13. An attachment as recited in claim 11 wherein said body is attached to said channel-shaped element by internal screw threads which engage the external threads of a screw post extending downwardly from said channel-shaped element bottom.

14. An attachment as recited in claim 9 wherein said braking element comprises a body of friction material having the shape of a truncated cone, and wherein a single braking element is connected to said channel-shaped element.

* * * * *